US005519370A

United States Patent [19]

Perreira et al.

[11] Patent Number: 5,519,370

[45] Date of Patent: May 21, 1996

[54] SEALED RELAY DEVICE

[75] Inventors: G. Stephen Perreira, Carpinteria; Richard L. Kutin, Camarillo; Bruce A. Kenney, Oxnard, all of Calif.

[73] Assignee: Kilovac Corporation, Carpinteria, Calif.

[21] Appl. No.: 205,526

[22] Filed: Mar. 4, 1994

Related U.S. Application Data

[63] Continuation-in-part of Ser. No. 140,275, Oct. 20, 1993, Pat. No. 5,394,128, which is a continuation of Ser. No. 10,496, Jan. 28, 1993, abandoned, which is a continuation of Ser. No. 900,553, Jun. 18, 1992, abandoned, which is a continuation of Ser. No. 676,974, Mar. 28, 1991, abandoned.

[51] Int. Cl.[6] ..... H01H 7/16

[52] U.S. Cl. ..... 335/154; 335/126; 218/123; 218/125

[58] Field of Search ..... 335/151–154, 335/78–86, 128, 129; 200/144 B, 218, 123, 124, 125

[56] References Cited

U.S. PATENT DOCUMENTS

Re. 29,174 4/1977 DeLucia ..... 335/154
3,697,907 10/1972 DeLucia ..... 335/201

*Primary Examiner*—Lincoln Donovan
*Attorney, Agent, or Firm*—Christie, Parker & Hale

[57] ABSTRACT

A sealed relay of the high-vacuum type, or which may be backfilled with a dielectric gas such as hydrogen-nitrogen mixture for improved arc suppression when switching high-voltage d-c currents. The relay uses controlled fixed contacts which enable use of a reduced-diameter disk-shaped movable contact. Thus permitting optimal placement of external arc-supporting permanent magnets on a ceramic relay housing in close proximity to the enclosed fixed and movable contacts. A staggered or offset positioning of the fixed contacts makes the relay polarity insensitive for bidirectional switching of high-voltage d-c currents.

10 Claims, 10 Drawing Sheets

SEALED RELAY DEVICE

CROSS REFERENCE TO RELATED APPLICATIONS

This application is a continuation-in-part of U.S. application Ser. No. 08/140,275 filed Oct. 20, 1993, now U.S. Pat. No. 5,394,128, which is a continuation of U.S. Ser. No. 08/010,496 filed Jan. 28, 1993, abandoned, which is a continuation of U.S. Ser. No. 07/900,553 filed Jun. 18, 1992, abandoned, which is a continuation of U.S. Ser. No. 07/676,974 filed Mar. 28, 1991, abandoned.

BACKGROUND AND DESIGN CONSIDERATIONS OF PRESENT INVENTION

Electrical relay devices which operate using electromagnetic principles are a well known and popularly used component employed in many electrical circuit applications. The relay device of the present invention is of the DC contactor type. These relay devices may be operated under high voltage/high current conditions typically having voltages in the 270 Volt DC range. One of the major consequences for relays that operate at these high voltages is that they normally operate in a "hot switching" (switching under load, causing arcing) environment with normal operating currents ranging from 25–1000 amps. The relays also have been known to have an overload interrupt capacity of 100 to 2500 amps and have also been known to have the capability to maintain low contact resistances on the order of 5.0–0.1 milliohms.

Relays of the DC contactor type can experience problems in "hot switching" environments in that there is no current zero point in the DC signal (as opposed to that of an AC signal) which can aid in breaking the arc which results from separation of the relay contacts while current is passing through them. Arcing due to contact "bounce" or "make" may cause puddling (contact melting) and possibly the welding together of the relay contacts which is the joining of the contacts together. It is difficult to extinguish these arcs which usually occur during the connection, or making, or the disconnection, or breaking, of the contact surfaces.

Arcing in relays results from the following phenomenon. The contacts may start off in the closed circuit "make" or open circuit "break" position. As they begin to come together or as they begin to separate from one another the separation between contact surfaces is infinitesimal. Hence, the electric field strength is intense and electrons are accelerated across the gap between the contacts. This leads to an electron avalanche effect resulting in the ionization of particles in the gap. Even if the relay contacts are maintained in a vacuum chamber, arcing may still occur in the absence of air.

In the cases of both an air-filled or an evacuated (vacuum) environment, continuous arcing may commence and a great amount of heat may be generated which melts the contact material. The hot, easily ionized material forms a contact plasma (plasma) as the contacts continue to come together, or as they separate. An arc column will then begin to form. This arc column will form from contact plasma in the case of a vacuum environment or from contact plasma along with ionized particles in the case of an air-filled environment. Contact material plasma and/or ionized particles will build up and develop a continuous trail of charged particles between the contacts and thereafter an arc will occur. The arc will finally be extinguished when the contacts come together, or when the contacts fully separate because the electric field strength between the contacts is not high enough to ionize contact material electrons.

When arcing occurs, a phenomenon known as puddling may occur which describes the actual melting of the contacts surface material. Puddling may cause craters to form on the contact surfaces in those locations where contact material has been melted away or when melted contact material has hardened in a coarse manner. Puddling may further lead to the welding together of the contacts making it difficult to separate them.

Welding refers to the joining of the contacts together either microscopically or more grossly due to the hardening of the melted contact material between the contacts. The occurrence of arcing and its associated puddling or welding of the contacts are most undesirable as they lead to deterioration of the relay contacts, dielectric breakdown, and finally, relay failure.

As from the differences already noted between DC contact rely "hot switching" in a vacuum, versus that in air, the following is also to be noted regarding relay "hot switching" in a vacuum. The vacuum has 1) a much greater voltage standoff capability, and 2) significantly reduces plasma formation. Such a reduction in plasma formation is approximately eight orders of magnitude less than the corresponding formation of ionized particles in air-filled chambers. The vacuum also eliminates contaminants which cause increased contact resistance over the operating life of the relay, eliminates ionized particles which cause oxidation and increased contact resistance, protects against explosions in hazardous environments, and petits the use of hard contact materials without sacrificing low contact resistance. By reducing contact wear, relay life will be increased.

In order to successfully connect relay contacts under load in either a vacuum or in an air-filled environment it is a common occurrence for the contacts to "bounce" during the period of contact closure. It is important at this juncture to note that the making of an electrical connection by connecting two contacts to one another is referred to as contact make or "make" while the disconnecting or separating of these contacts is referred to as contact break or "break".

It is necessary to reduce any arcing, puddling, and/or welding between the contact materials so as to enable the relay contacts to completely be disconnected from each other every time a contact "break" is desired.

In the DC contactor relay design of the present invention, the creation and/or occurrence of ionized particles or contact plasma may be reduced by the elimination of air such as by employing a vacuum chamber so as to minimize particle ionization, and by utilizing contacts made of a high temperature material which is hard to ionize. It is also desirable to increase the contact gap quickly upon contact break so as to allow the gap to increase before a sufficient amount of contact plasma and/or ionized particles, which are needed to sustain an arc, form in the gap. It is important to note that a vacuum also reduces the gap distance required to reach open circuit voltage.

It is also desirable to use additional means to increase the voltage required to sustain an arc. This may be accomplished by using permanent magnets to alter the field between the contacts, thereby making it more difficult for the arc sustaining ionized particles or contact plasma to be maintained. Therefore, the arc will be extinguished. Arc chutes which are well known in the art, and which draw the arc away from its straight path between the contacts, may also be employed to augment this function.

The employment of vacuum technology in relay design also reduces design conflicts and improves relay performance in that large contact cross sectional areas are no longer required to maintain low contact resistance. This results in a lower contact resistance per unit area and, therefore, reduced relay size and weight. Further, large contact gaps are not required in a vacuum environment as the vacuum is a far better dielectric than air. This feature also facilitates a reduced relay size.

The use of a vacuum relay device also provides for a faster acting actuator as there is no air drag on the moving contact. Further, a more efficient armature design may be accomplished in the absence of air. These above-mentioned factors also lead to a reduction in both the size and weight of the relay device. The vacuum also facilitates fast arc dissipation as the arcs move 100 times faster in a vacuum than in air. This feature also facilitates a size reduction.

The relay device of the present invention is capable of interrupting high current values at 270 VDC. In order to do so, conflicting design criteria come into play. The relay requires a large contact gap which, in turn, tends to increase the physical size and weight of the relay. Such a relay also requires quick retracting contacts which requires a corresponding decrease in the weight of the contacts.

In the area of reducing power consumption by these relays, it is desirable to minimize the contact resistance. This requires a large contact cross-sectional area which tends to increase contact size and weight and requires a corresponding increase in coil size and weight. The minimization of contact resistance also requires a large contact force which requires an increased coil size and weight. Power consumption could also be reduced by minimizing coil heating. This requires a small actuator coil which decreases the size and weight of the coil. Power consumption may further be reduced by allowing puddling to occur. This requires a large actuator force upon the contacts, and therefore, increases the coil size and weight. Lastly, power consumption may be reduced by using smaller parts which allow for the decrease of the size and weight of the relay device and its components.

Relays are basically comprised of a coil which is energized by an electrical current flowing therein. The current flowing therein creates an electromagnetic field which moves an armature in such a manner so as to bring at least two electrical conductors or contacts into connection with one other. As a result, the electrical circuit to be serviced by the conductors is closed and current will flow through the desired circuit. It is at the location of these contacts or conductors where the aforementioned arcing and its associated problems occur.

Arcing is more severe in DC relays than in AC relays. This is due to the fact that the AC signal varies sinusoidally and periodically over time and through a zero value at which point a circuit disconnect or "break" may be effected. The effects of the arcing, puddling, and welding, while they may not be totally eliminated, can be reduced by a proper design concept. One way to eliminate or alleviate the problems associated with arcing, puddling, or welding is to provide for a significant amount of force during that instance in time when it is desired to disconnect or separate ("break") the connection between the contacts. This application of force to effect a contact break is known in the art as "impact break". The present invention utilizes an armature shaft in motion prior to the contact break in order to perform this "impact break".

Relays of the DC contactor type which utilize "impact break" methods, come in a number of varieties. The method employed in the present invention utilizes the kinetic energy of a moving armature to provide the physical force necessary to "break" the connection between the movable contact and the stationary contact of the relay device. This is accomplished by using a sudden force of impact which will disconnect the connection between the contacts and break any welding connection which may exist between them.

The present invention is a new and improved version of a "linear" impact break relay. An armature and plunger, upon the excitation of a coil and subsequent magnetic field established thereby, is driven in such a direction (linear direction) towards the relay's electrical stationary contacts. The driving force is typically the magnetic flux linking a stator/armature assembly, and the resultant force moves the armature towards the stator, which activates movement of a plunger attached to the armature. The armature or plunger typically drives a conductor or moving contact in the same (linear) direction as its own movement until the conductor or moving contact makes contact with one or more stationary contacts in order to complete the electrical circuit to be serviced by the relay. Upon this contact "make" the electrical circuit is now complete and operational.

When the coil is de-energized, the armature or plunger will be driven in the opposite direction, usually by the force of a biased spring, thereby forcing the moving contact driven by it away from the stationary contact thereby "breaking" the connection between the contacts and opening the electrical circuit.

The force of the returning armature is applied in line with, or linear to, the contacts so as to effect a contact "impact break" with a force which is also in line with or linear to the motion of the armature.

SUMMARY OF THE PRESENT INVENTION

The present invention provides for a relay device of the DC contactor type which utilizes a linear "impact break" method to achieve contact break. The relay device of the present invention, when in an open contact position, with its coil deenergized, utilizes a spring element to prevent the armature or plunger from driving the moving contact attached thereto into contact with the stationary contacts. The armature has attached at one end a plunger which is situated at the base of the core portion of the relay structure. A kick-off spring serves to provide a biasing force so as to maintain the plunger and the armature in an open contact state. The armature comprises a shaft and has mounted thereon all of the other components of the armature or plunger assembly. Attached to the armature shaft at its end opposite the core base is a moving contact disk which is rotatable about the armature shaft. The moving contact disk is circular and is capable of coming into contact with two stationary contacts so as to complete the electrical circuit which they are to service. A movably mounted over-travel spring is located about the armature shaft and situated between a stop washer, which is rotatably fixed in its position on the armature shaft, and a disk washer assembly, which is also fixably connected to the moving contact disk.

The moving contact disk and its associated washer are also rotatable about the armature shaft. The over-travel spring located between the stop washer and the moving contact disk/disk washer assembly rotates freely upon its compression.

When the coil of the relay is energized, the plunger located in the core base region will be "pulled" into the core center against the force of the kick-off spring, thereby driving the armature shaft and forcing the moving contact disk into contact with the stationary contacts. Even after the contacts initially come into contact with one another, the armature and plunger continue to move towards the stationary contacts until they reach their final destination alongside the core center inside the relay core region. Therefore, the armature and plunger of the present invention has a greater field of movement than does the moving contact disk. This continued movement by the armature and plunger and the associated armature shaft, after the moving contact disk makes contact with the stationary contacts causes the compression of the over-travel spring. By compressing the over-travel spring further, the armature shaft and its terminal end portion continues to move independent of the moving contact now constrained by the stationary contacts. The over-travel spring continues to be compressed until the armature's movement ceases. Upon coil de-energization, the armature and plunger are forced from the core region, thereby returning to their initial position. The kick-off and over-travel springs provide the biasing force for the armature and plunger to retract into the core base. Also, the over-travel spring will be allowed to fully expand, thereby pulling the terminal end portion of the armature shaft towards the moving contact disk until it forcefully impacts against, or strikes, the moving contact disk in order to provide an "impact break" force sufficient to break the connection and any welding that has occurred between the contacts.

The present invention is encapsulated within a vacuum chamber and further provides features which serve to reduce arcing, puddling, and welding by employing spherically terminated, stationary contacts which have a terminal flat portion designed to meet or connect with the moving contact disk. The moving contact disk is of a specifically chosen diameter such that it, along with the spherical nature of the stationary contacts, minimizes closely spaced confronting cross-sectional areas between the two which further reduces arcing and dissipates plasma pressure. The moving contact disk should be flat at its points of contact with the stationary contacts. Further, the stationary contacts are made of higher strength metals which resist melting and puddling. Permanent magnets are utilized inside the stationary contacts to disrupt the plasma and/or ionized particle formation so as to extinguish arcing.

As described previously, arcing, puddling, and welding are likely occurrences in relays such as these upon contact "make" and "break". This may cause cratering in the moving contact disk which, if allowed to continue over time at the same areas, can lead to disk deterioration or complete burn-through on the disk.

The present invention alleviates this cratering problem by rotating the moving contact disk so that arcing will occur at different locations along its surface and, therefore, not on the same area on the disk's surface time after time. Therefore, the present invention provides for a rotating moving contact disk which is rotated by the rotation of the over-travel spring upon its compression. While such rotation is not uniform and may be erratic, its sum total effect is to provide for disk rotation over time so that the cratering caused by the arcing or any welding will be evenly distributed along the surface of the moving contact disk.

The relay of the present invention further provides that all moving parts including an armature assembly are under vacuum. This very significant feature permits all the moving parts of the linear relay to be under vacuum, and this avoids weak link interface parts such as prior art bellows interconnecting moving parts outside the vacuum with moving parts inside the vacuum.

It is an object of the present invention to provide an electric relay of the linear "impact break" DC contactor type for the purpose of connecting and disconnecting the contacts to an electrical circuit which utilizes a moving contact disk which rotates upon continued activation so as to evenly distribute any detrimental effects of occurrences such as arcing, cratering, or melting which occurs on the moving contact disk.

It is an object of the present invention to provide a linear "impact break" DC contactor relay which utilizes optimal design geometries and characteristics for the design of its contacts so as to eliminate or alleviate the effects of arcing and its consequences.

It is a further object of the present invention to provide a linear "impact break" DC contactor relay device which utilizes permanent magnets situated inside stationary contacts the presence of which serves to reduce the occurrence of arcing.

It is yet a further object of the present invention to provide a linear "impact break" DC contactor relay device wherein all moving parts are under vacuum.

These and other objects and advantages of the present invention will become apparent from the following description of the preferred embodiment of the invention made in connection with the following drawings.

DETAILED DESCRIPTION OF THE PREFERRED EMBODIMENT

Figure 1:
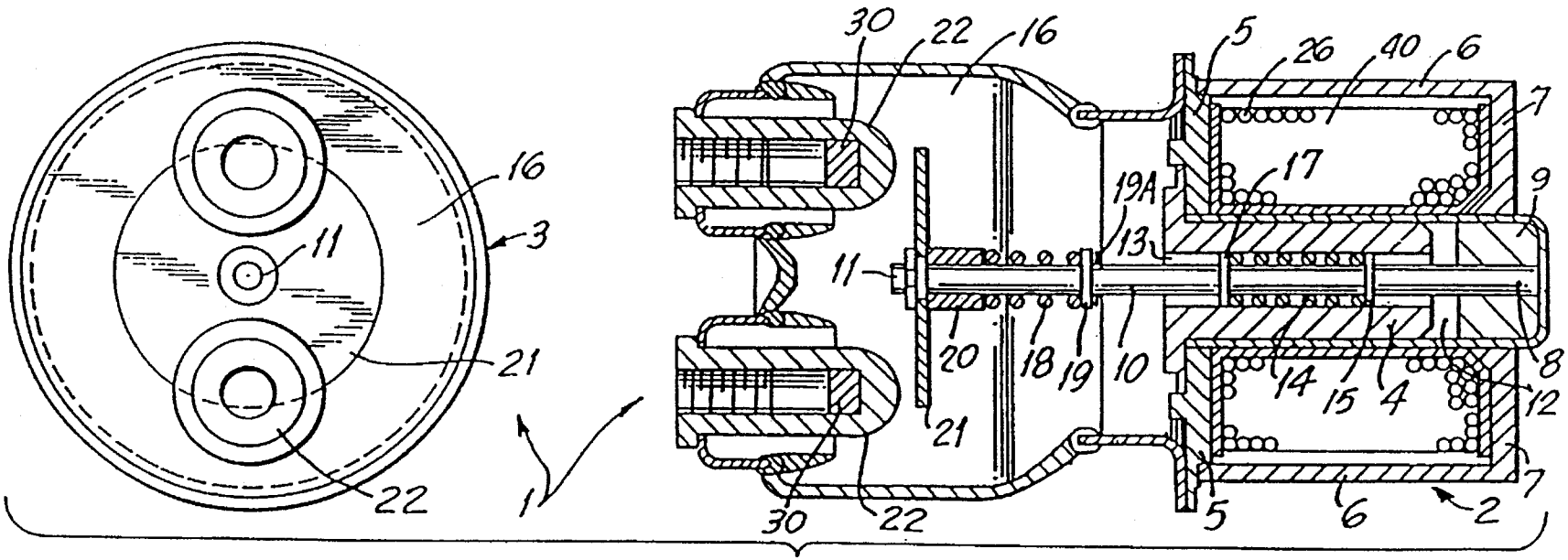
FIG. 1 illustrates side and top views of the relay device of the present invention in an open contact position.

The side and top views of the relay device of the present invention are illustrated in FIG. 1. The relay device of FIG. 1 is designated generally by the numeral 1 and comprises a base region or core assembly 2 and a glass or ceramic structure 3 which encapsulates the remaining relay components to be described below.

The relay 1 of the present invention is evacuated so that structure 3 encapsulates a vacuum chamber 16. The core assembly 2 further comprises of core center 4, a core base top portion 5, exterior core walls 6, and a core bottom base portion 7, all of which are made from a ferromagnetic material.

Coil 26 is wound around the base core center 4 in the hollow cavity 40 formed between the core center 4, core base top portion 5, exterior core walls 6, and core bottom base portion 7. The coil 26 is preferably of the 12 to 18 watts power capacity. A hollow cylindrical armature travel cavity 13 extends axially through the core center 4 through which passes the armature assembly 8. The armature assembly 8 includes an armature shaft 10 which extends through travel cavity 13 and into vacuum chamber 16. Attached to armature shaft 10 at one end is plunger 9. At the end opposite the plunger 9, the armature shaft 10 has fixedly connected thereto a terminal end portion 11 which has a diameter greater than the diameter of the armature shaft 10.

Figure 2:
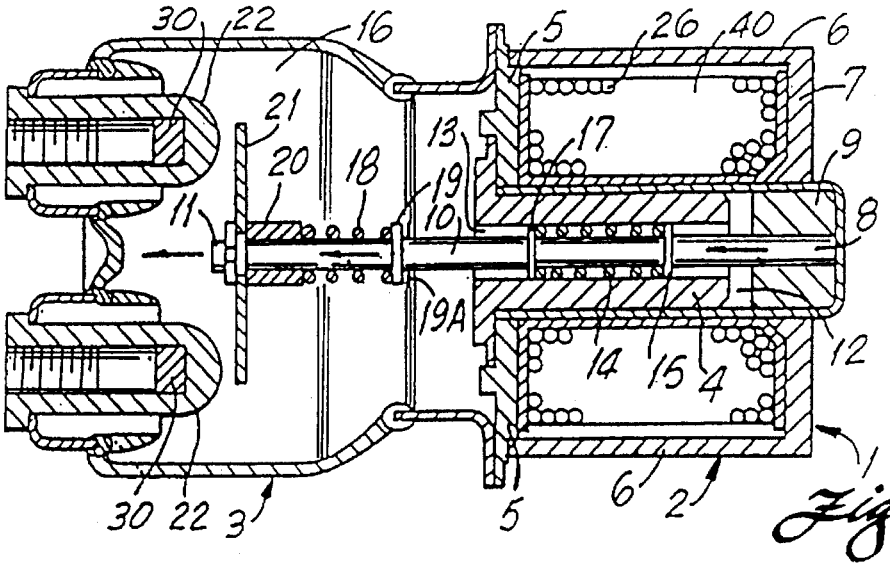
FIG. 2 illustrates a detailed side view of the relay of the present invention in an open contact position just prior to energization of the relay coil.

There exists a gap 12 between the plunger 9 and the core center 4. The gap 12 provides the space for the plunger 9 to move upon activation of the relay 1 as will be described below. The armature shaft 10 travels through the armature travel cavity 13. Located in the armature travel cavity 13 is a kick-off spring 14 which is a helical spring and is positioned so as to be fixedly connected to the armature shaft 10 at its end closest to the plunger 9 by clip 15. The other end of the kick-off spring 14 is fixedly connected to the base core center 4 at the interior portion of the armature travel cavity 13 by bushing 17 as shown in FIG. 2. Surrounding armature shaft 10 is an over-travel spring 18, which is located between a stop washer 19 which is permanently, but rotatably, fixed by clip 19A to the armature shaft 10 at the location shown in FIG. 2, and a moving contact disk washer 20. Over-travel spring 18 is also a helical spring. The stop washer 19 and moving contact disk washer 20 are freely rotatable about the armature shaft 10. Movable contact disk 21 and its corresponding washer 20 are both freely rotatable around, and freely movable about, the armature shaft 10. Further, the moveable contact disk 21 and its corresponding washer 20 are movable along the armature shaft 10, between the terminal end portion 11 and the stop washer 19 with such movement limited only by the over-travel spring 18. Both the stop washer 19 and the moving contact disk washer 20 are loosely fitted around the armature shaft 10 so that both rotate around said shaft 10. The over-travel spring 18 is free floating and is, therefore, not permanently connected to either the stop washer 19 or the moving contact disk washer 20. As such, the over-travel spring 18 is free to rotate about the armature shaft 10 as it is compressed as will be described below. Further, depending upon the friction inherent on the aforementioned structures at the particular moment, the over-travel spring 18 will cause either the moving contact disk washer 20 and the moving contact disk 21, or the stop washer 19, to rotate.

At the top end (left side) of the chamber 16 in FIG. 2, are located the stationary contacts 22 which are cylindrical and hollow and have permanent magnets 30 placed therein. Stationary contacts 22 and moving contact disk 21 have a special design as will be described below which is specifically employed to reduce arcing and dissipate plasma pressure and their consequential effects such as the associated puddling and welding. The permanent magnets 30 placed inside the stationary contacts 22 are preferably cylindrical and of the small, rare earth variety.

The relay device of the present invention provides that all moving parts including those within the chamber 16 along with the armature assembly 8 which includes plunger 9, the armature shaft 10, the gap 12 which initially exists between the plunger 9 and the core center 4, the armature travel cavity 13, the kick-off spring 14, clip 15, and the bushing 17, are all under vacuum. This very significant feature permits all moving parts of the linear relay to be under vacuum and thus avoids weak link interface parts such as prior art bellows interconnecting moving parts outside the vacuum with moving parts inside the vacuum.

As described previously, FIG. 2 depicts the open circuit or contact break condition, wherein moving contact 21 is not in connection with stationary contacts 22. Therefore, an open circuit condition exists.

Figure 3:
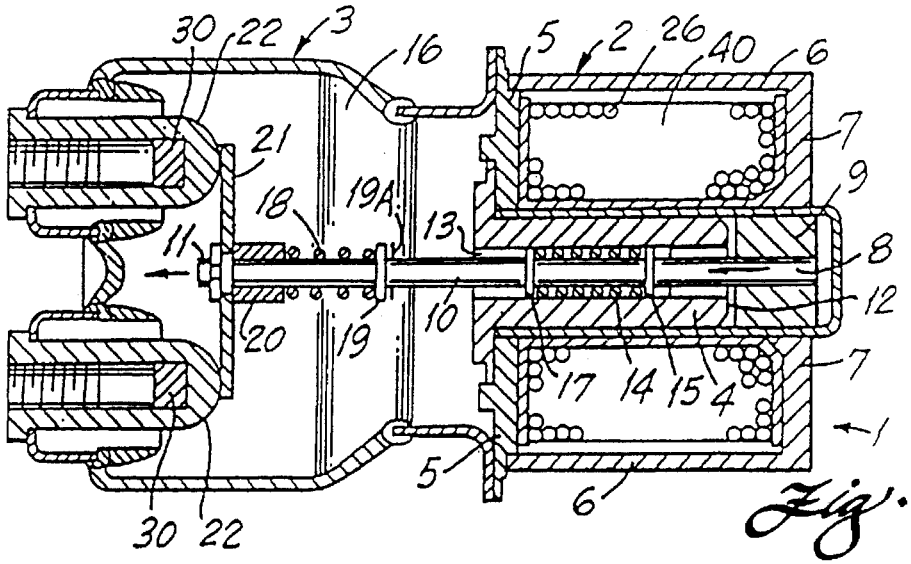
FIG. 3 illustrates the relay of the present invention in an initial (intermediate) contact make condition prior to its armature finally coming to rest in the core center.
Figure 4:
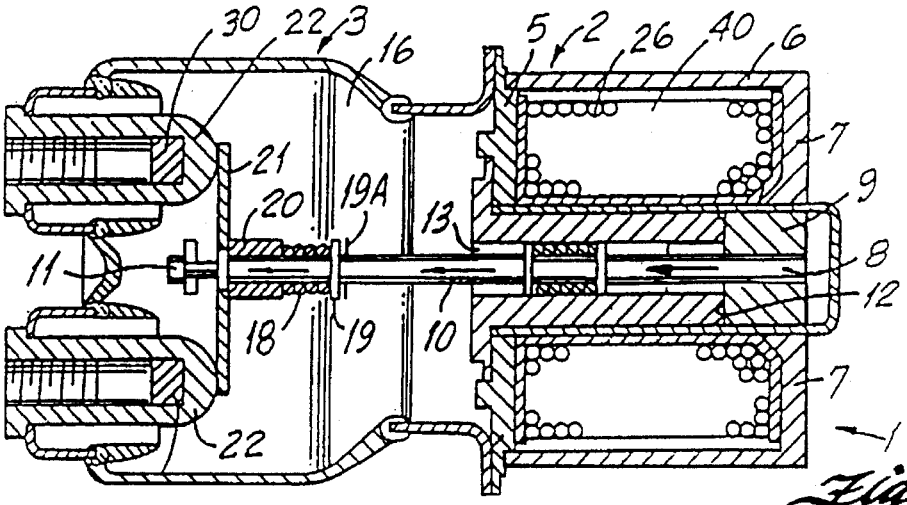
FIG. 4 illustrates the relay of the present invention in its final contact "make", closed contact, position.

The operation of the device 1 will now be described with reference to FIGS. 2 through 7. Referring to FIG. 2, upon the energization of coil 26 by the flow of electric current therein, a magnetic field 27 having the direction, as shown by arrow 50, will be created. The magnetic field 27 will cause the plunger 9 to close the gap 12, overcoming the biasing force of the kickoff spring 14, and begins to move said plunger 9 in the direction towards the core center 4. As this movement by the plunger 9 occurs, kick-off spring 14 will compress as one end is connected to the armature shaft 10 and the other is connected to bushing 17. Therefore, the armature shaft 10 driven by the attached plunger 9 will travel further into the vacuum chamber 16. The movement of the armature shaft 10 continues as the moving contact disk 21 comes into contact (contact "make") with the stationary contacts 22 as shown in FIG. 3. The plunger 9 and the armature shaft 10 thereafter continue to move in the direction of the stationary contacts 22 until the gap 12, initially between the plunger 9 and the core center 4, is completely closed. As this plunger 9/armature shaft 10 movement continues, the moving contact disk 21 remains in contact with the stationary contacts 22. The over-travel spring 18 accordingly compresses between the stop washer 19 and the moving contact disk washer 20 as the armature shaft 10 continues its travel so as to maintain this contact while at the same time preventing damage to the stationary contacts 22 and the moving contacts disk 21. As the over-travel spring 18 continues to be compressed, the terminal end portion 11, attached to the end of the armature shaft 10, will move away from the moving contact disk 21 and into the open space of the vacuum chamber 16 between the stationary contacts 22 as shown in FIG. 3. When the plunger 9 has completely closed the gap 12 between itself and core center 4 as shown in FIG. 4, the kick-off spring 14 and the over-travel spring 18 will be compressed. Hence, the energization of the coil 26 creates an amount of electromagnetic force sufficient to compress both the kick-off spring 14 and over-travel spring 18, as described above, in order to effect a contact "make" condition.

Figure 7:
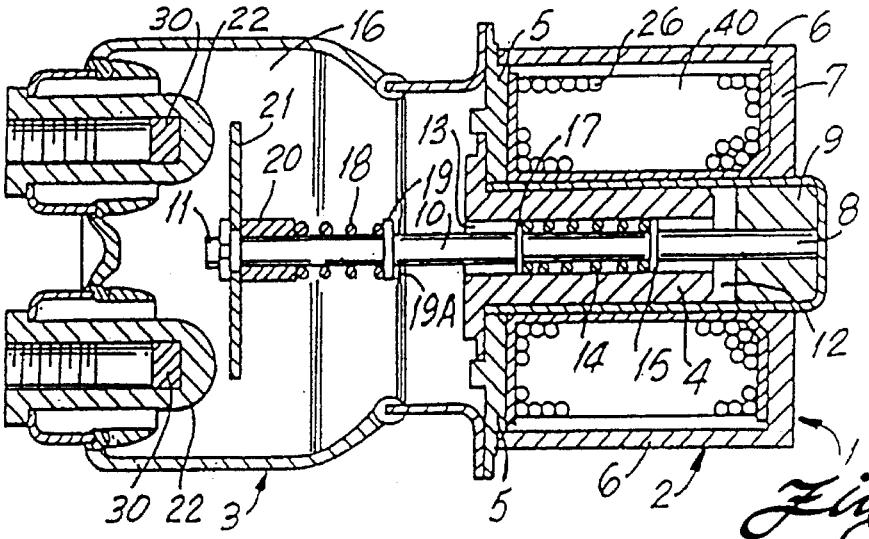
FIGS. 5–7 illustrate the sequence of events which occur in the relay device of the present invention subsequent to coil deenergization as contact break is effected.
Figure 6:
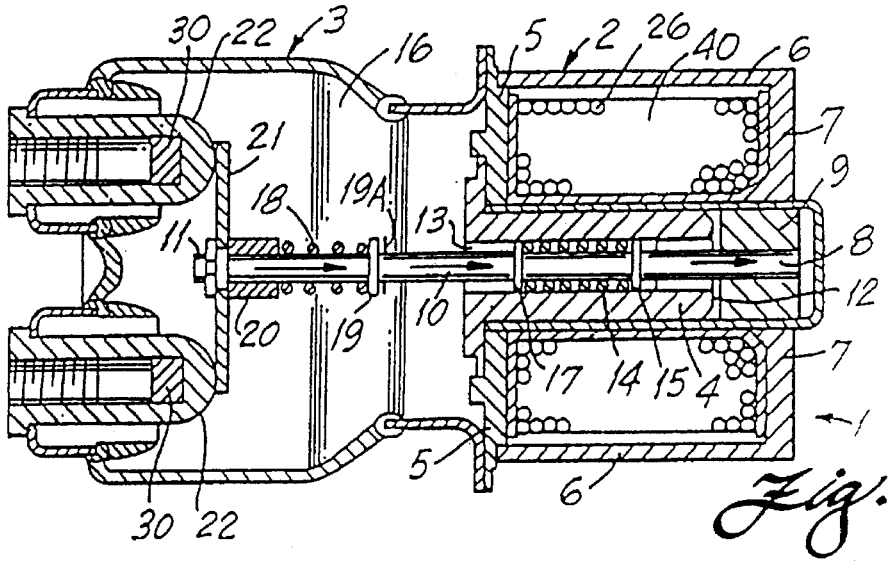
Figure 5:
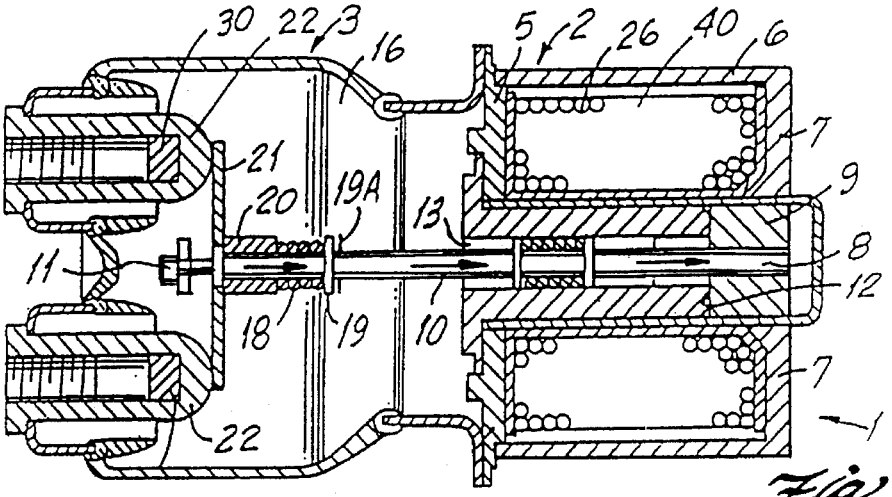

Referring now to FIGS. 5 through 7, the operation of the relay device of the present invention as it effects a contact disconnect or contact "break" will be described when the coil 26 is de-energized, the magnetic flux field 27 collapses, as shown in FIG. 5, and there is no longer a magnetic field to act upon the plunger 9. In the absence of magnetic field 27, the plunger 9 and the armature shaft 10 will succumb to the biasing force of the kick-off spring 14 and over-travel spring 18 and will begin to move in the opposite direction, as shown, away from the vacuum chamber 16 and the stationary contacts 22. Accordingly, the plunger 9 will move away from the core center 4, thereby re-creating gap 12 between them. As a result, the kick-off spring 14 will expand quickly, thereby forcing the armature shaft 10 and the plunger 9 in the direction described above. As this travel by the armature shaft 10 continues, the over-travel spring 18 will expand quickly and with a sufficient amount of force, will pull the terminal end portion 11, attached to the end of the armature shaft 10, towards and forcibly against, the moving contact disk 21. The relative motion of the armature shaft 10 with respect to the moving contact disk 21 will cause the terminal end portion 11 to forcefully strike (impact) upon the moving contact disk 21, thereby "breaking" its contact with the stationary contacts 22 as shown in FIG. 6. This action will disconnect these contacts and break any welding which may have occurred between them. Thus, this impact by the terminal end portion 11 upon the moving contact disk 21 provides the "impact break" in the linear direction as such is the direction of the movement of the armature shaft 10. The armature shaft 10 and plunger 9 will continue to move until the plunger 9 reaches the end of its travel in the relay core assembly 2, as shown in FIG. 7, upon which time the relay 1 will be in its open contact position.

As was described previously, arcing, puddling, and welding are major problems in DC relays such as in the DC relay of the present invention. As described above, when the moving contact disk 21 and stationary contacts 22 "make" or "break" with each other in "hot switching" environments, of which the present invention will almost always be operating within, arcing will occur which will cause for puddling and welding. As a result, craters may form on surfaces of the contacts and especially on the moving contact disk 21. These craters result in poorer electrical connections (contact "makes") and if allowed to occur at the same region of the moving contact disk 21 time after time, may result in contact deterioration or total contact burn-through therefore resulting in holes in the moving contact disk 21.

The present invention seeks to reduce the effects of arcing, puddling, and welding by providing for a moving contact disk 21 which rotates about the armature shaft 10 so as to effectively prevent the same areas of the surface of the moving contact disk 21 from coming into contact with the stationary contacts 22 time after time. The preferred configuration for such an arrangement is as described below.

Figure 8:
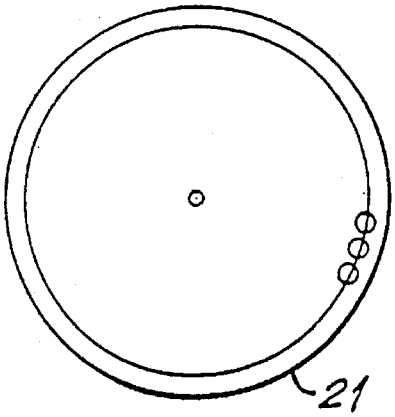
FIG. 8 is an illustration of a top view of the moving contact disk and the surface craters which form a circle on the surface thereon which results from arcing and its consequences.

Cratering on the surface of the moving contact disk 21 is illustrated in FIG. 8. In the preferred embodiment of the present invention, the diameter of the moving contact disk 21 is preferably 1.125". With a contact surface on the stationary contacts 22 at preferably 0.075", the choice of which will be described in more detail below, craters having diameters which range from 0.050" to 0.100" in diameter will form on the surface of the moving contact disk 21, along a circularly symmetric region, chosen by design to be of a diameter of 1.000" about the center of the moving contact disk 21. As will be described later, the surfaces of the stationary contacts 22 are preferably 1.000" apart from one another. By employing a moving contact disk 21, these craters are prevented from occurring in the same point repeatedly which could lead to poor electrical contacts during "make" or more seriously, complete contact burn-through These craters may also overlap each other during one complete revolution of the moving contact disk 21. With a moving contact disk 21 diameter of 1.125" and a diameter of 1.000" being descriptive of the crater circle, a circumference for a crater circle of approximately 3.000" will exist. As a result, there may be as many as 40 full craters overlapping each other in some manner on the contact surface of the moving contact disk 21. By utilizing a rotating moving contact disk 21, the arcing will not occur at the same point on the moving contact disk 21, and hence, a longer operating life for the moving contact disk 21 will be achieved.

Figure 9:
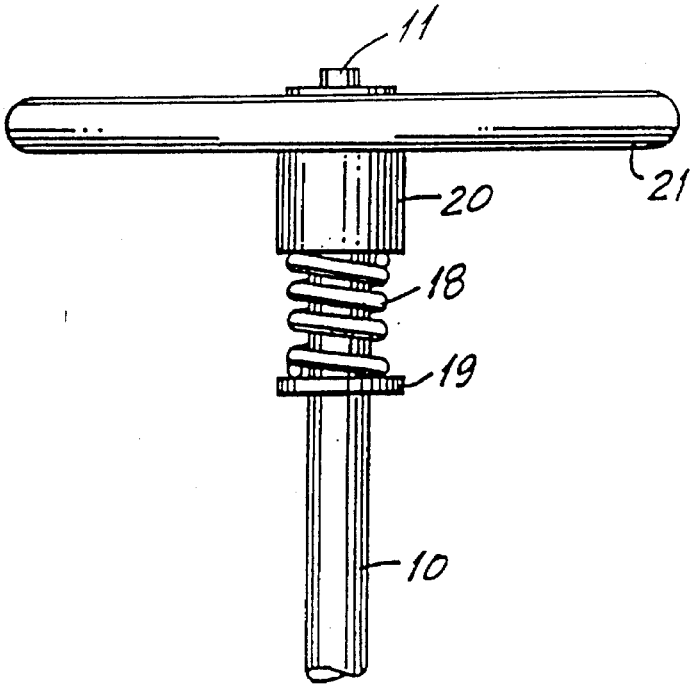
FIG. 9 illustrates the mechanism by which the over-travel spring provides for the rotation of the moving contact disk.

Referring now to FIG. 9, the mechanism by which the moving contact disk 21 is rotated will be described in more detail. FIG. 9 illustrates the armature shaft 10 with the terminal end portion 11 attached at the end adjacent to the moving contact disk 21. Moving contact disk washer 20 abuts, but is not fixed to, the moving contact disk 21. Stop washer 19 is also located fixedly to the armature shaft 10 and is freely rotatable thereabout. Over-travel spring 18 is located about the armature shaft 10 and between the stop washer 19 and the moving contact disk washer 20 as shown in FIG. 9. As described above, the moving contact disk 21 and the moving contact disk washer 20 are not fixedly connected to each other and both may freely move along, and rotate about, the armature shaft 10. The stop washer 19, while fixedly connected by means of clip 19A to the armature shaft 10, is also freely rotatable about the armature shaft 10. The over-travel spring 18 is a free standing, helical spring which is not connected in any way to the stop washer 19 or to the moving contact disk washer 20. As such, the over-travel spring 18 is free to rotate about the armature shaft 10 in between the two washers 19 and 20.

Figure 10:
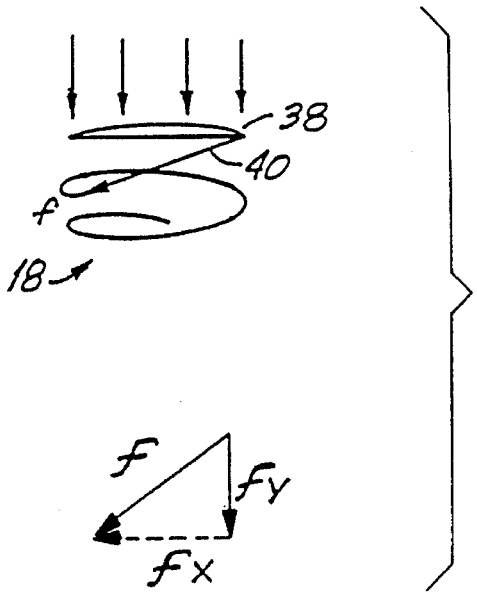
FIG. 10 is a diagram illustrating the component forces which act on the over-travel spring as it is compressed.

Helical springs, such as that employed as over-travel spring 18, have a tendency for their ends to rotate as the spring itself is compressed. This phenomenon of spring rotation may be described with the aid of FIG. 10 and the force diagram associated therewith. In FIG. 10, a portion of the top end of the over-travel spring 18 is shown. Note that the downward force F which is applied from moving contact disk 21 will be applied uniformly at the top end of the over-travel spring 18. This force F from the moving contact disk 21 will force compression of the spring 18. In so compressing the spring, coil portion 40, adjacent the end portion 38 of the over-travel spring 18, will produce a force f in the direction of the coil portion 40 as shown by the arrow in FIG. 10 in the f direction.

As shown in the accompanying force diagram of FIG. 10, the force f on the over-travel spring 18 will be resolved into vertical $f_y$ and horizontal $f_x$ components. As a result, the coil 40 of the over-travel spring 18 and hence, the over-travel spring 18 itself will experience a horizontal force $f_z$ acting upon it which will tend to cause it to rotate about the armature shaft 10 upon each spring compression of the over-travel spring 18.

In the embodiment of FIG. 9, the moving contact disk 21, the associated disk washer 20, and the stop washer 19 are all capable of rotating in either direction around the armature shaft 10. Therefore, every time the spring is compressed it is capable of rotating in a horizontal direction and will cause either the rotation of the moving contact disk 21, via the moving contact disk washer 20, or the stop washer 19. The nature and occurrence of friction at the time of each compression will dictate which of the washers 19 or 20 is rotated by the over-travel spring 18. If the over-travel spring 18 rotates the moving contact disk washer 20, the moving contact disk 21 will rotate. If, on the other hand, the stop washer 19 is rotated, the moving contact disk 21 may not rotate.

Since it is not certain which washer 19 or 20 will be rotated by the over-travel spring 18, moving contact disk 21 rotation is neither uniform nor steady but is rather erratic due to the erratic rotation of the over-travel spring 18. The fact that the rotation of the over-travel spring 18 is not always acting on the disk washer 20 but may act also on the stop washer 19, and the fact that there exists an independent rotation of the armature shaft 10 itself in both directions, could also affect the rotation of the moving contact disk 21. Erratic disk rotation also results from washer slippage at the sites of both washers 20 and 19 and from the fact that the armature shaft 10 is capable of rotating in both directions which may add to the above process.

While such moving contact disk 21 rotation is erratic and not uniform, it does average out, over time, into a useful rotation. It has been determined that one full rotation of the moving contact disk 21 is capable of occurring every 500 to 5000 spring compression or cycles.

It has also been determined that after approximately 50,000 spring compressions, or cycles, the rotation of the moving contact disk 21 seems to even itself out so that the crater rings formed on the surface of the moving contact disk 21 will be evenly distributed about the surface contact area of the moving contact disk 21. This will provide for better electrical contacting and a prolonged life for the relay.

In addition to utilizing a rotating, moving contact disk 21, the relay 1 of the present invention further utilizes design improvements which will reduce arcing and dissipate plasma pressure and their deteriorative effects. These design improvements include using conductors which are terminated in spherical shells with terminal flat portions as the stationary contacts 22, utilizing stationary contacts 22 made of hard metals such as tungsten or molybdenum which provide for reduced melting of the contact surfaces and therefore less plasma creation, utilizing a movable contact disk 21 having a length and shape which reduces closely spaced confronting contact surface areas, and utilizing permanent magnets 30 situated inside the stationary contacts 22 to extinguish any arc columns which may form between the stationary and moving contacts.

Figure 11:
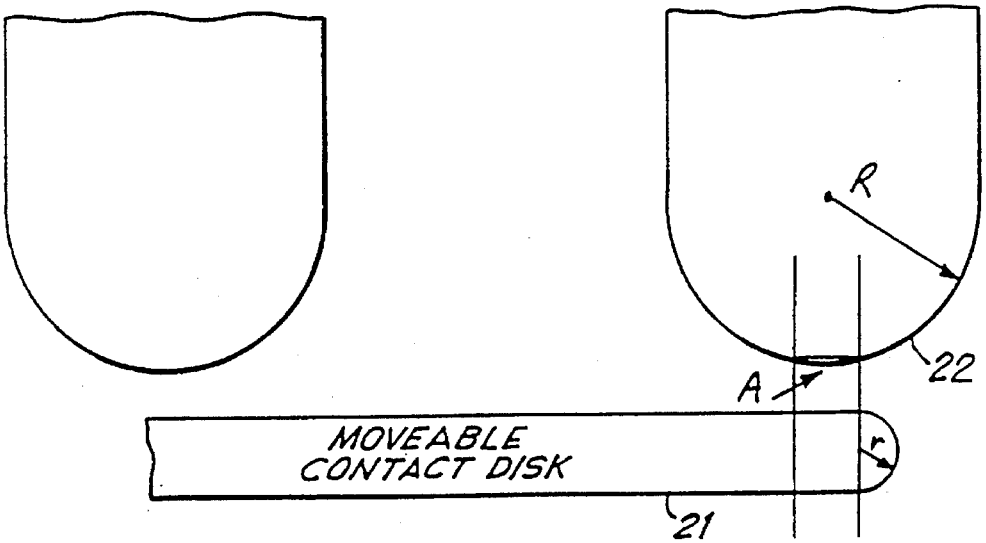
FIG. 11 illustrates a side view of the design geometry of the stationary and moving contacts so as to illustrate the optimal design and configuration of these contacts in order to reduce arcing.

FIG. 11 illustrates a preferred structure for the stationary contacts 22 and the moving contact disk 21 as seen from a side view. The contacts are illustrated in an open contact "break" condition in the vacuum chamber 16 of the relay 1. The stationary contacts 22 are preferably spherical in shape at their terminal ends, and they are designed, for a preferred embodiment, to have a diameter of 0.420" and a terminal radius R of 0.210". The stationary contacts 22 make contact with the moving contact disk 21 at a terminal flat region A as shown in FIG. 11. The provision of the terminal flat region A at the contact location of the stationary contacts 22, and a flat moving contact disk 21 surface at this region, provides for a flat surface contact area. This will result in a better contact connection upon "make" and less arcing will, therefore, occur upon "make" and "break". The terminal flat region A of the stationary contact 22 should be no smaller than 0.050" and no larger than 0.100". It is preferable for the terminal flat A to be 0.75" for the preferred embodiment. It should be noted that if the surface contact area is too small, the contacts may fail to handle the electrical connection properly. If however, the contact surface is too large, the geometry of the stationary contact 22 and the moving contact disk 21 would too closely approach that of two flat plates, and therefore, more arcing and less arc dissipation may occur between the contacts.

The centers of the terminal flats A of the stationary contacts 22 are preferred to be 1.000" apart. This also explains why the craters on the moving contact disk 21 form in a circle having a diameter of 1.000". As described above, despite the utilization of the vacuum chamber 16 in the present invention, contract plasma will form from the "hot switching" of the contacts 21 and 22 with one another. By having a greater contact area, more plasma can form in the gap between contacts and such plasma is less likely to be dissipated before doing the damage described earlier from the resulting arcing, puddling, and welding. Therefore, it is preferable to the extent possible (consistent with sufficient contact surface) to minimize closely spaced confronting contact areas between the contacts so as to allow for the dissipation of the plasma and plasma pressure created thereby during "hot switching".

The terminal radius R which is the radius of the fixed contact sphere 22 at its terminal end should be of the full radius of the stationary contact 22 80 so as to provide for maximum plasma dissipation. A radius smaller than the terminal radius (i.e. the slight rounding of the corners of an otherwise rectangular or cylindrical stationary contact) will cause too much flat surface parallel to the moving flat contact disk 21 while a larger terminal radius will produce a terminal portion of the stationary contact which starts to approach a flat plate contact as the curvature may be only slight.

In order to further reduce closely spaced confronting contact areas of contacts 21 and 22, special design consideration is given to the moving contact disk 21 which is also shown in FIG. 11. As shown, the moving contact disk 21 has a thickness of 0.050" and a terminal radius r at its end portion of 0.025", which also minimizes confronting flat contact surfaces.

The amount of distance by which the moving contact disk 21 should overlap the terminal flat region A of the stationary contact 22 also is important. With reference to FIG. 12, the moving contact disk 21 flat surface/stationary contact 22 terminal flat region A overlap, X, must be somewhere between just bare minimum moving contact/terminal flat overlap, as shown in FIG. 12A, to no more than one full terminal flat overlap portion as shown in FIG. 12B.

Figure 12A:
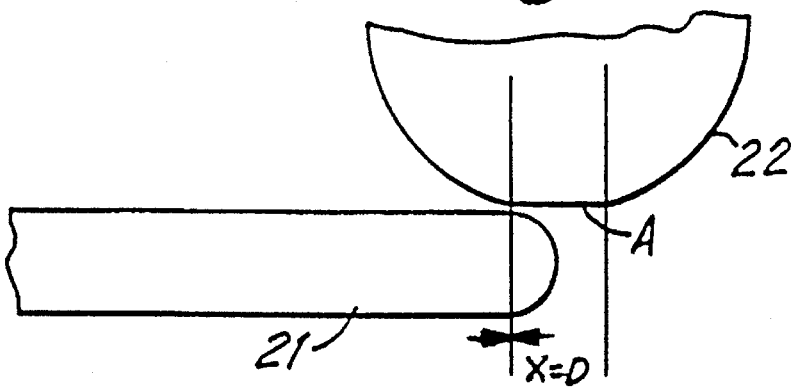
FIGS. 12A, 12B, and 12C illustrate the possible design alternatives for effecting a contact connection between the moving contact disk and the stationary contacts.
Figure 12B:
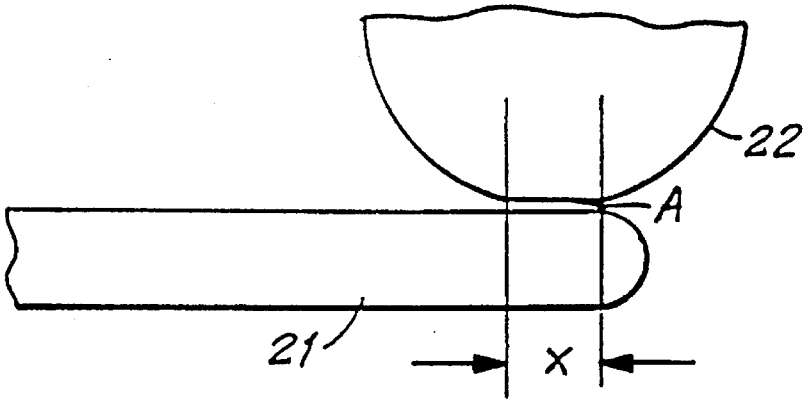
Figure 12C:
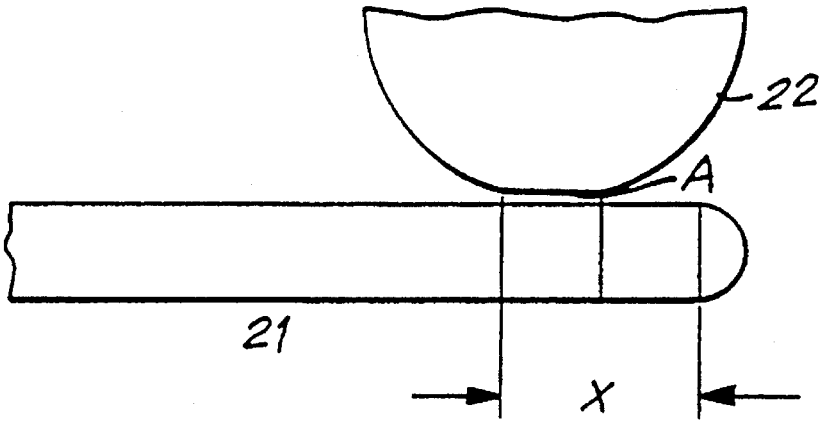

While the configuration of FIG. 12A may be suitable, it does not provide the optimal results as does the configuration of FIG. 12B, wherein the overlap of a full diameter thickness portion of the moving contact disk 21 is equal to the dimension of the terminal flat A region of a stationary contact 22. The reason why the configuration of FIG. 12B is not as optimal as that of FIG. 12C is because, in FIG. 12A, the terminal flat A region of the stationary contact 22 does not come into complete contact with the surface of the moving contact disk 21. Instead, a gap or space will be present which would induce arcing and its associated effects. FIG. 12C is not optimal as there exists too large a portion of the moving contact disk 21 which extends beyond the terminal flat A region of stationary contact 22. This configuration of FIG. 12C would cause arcing and less plasma dissipation in the space to the right of FIG. 12C between the stationary and moving contact surfaces that are not in contact with one another.

In order to further reduce arcing and welding in the present invention, it is preferable to employ stationary contacts 22 which are composed of metals such as tungsten or molybdenum which are hard metals and, as such, have less of a tendency to puddle or melt off during "hot switching" applications. This will result in less plasma creation and, therefore, less arcing.

Figure 13A:
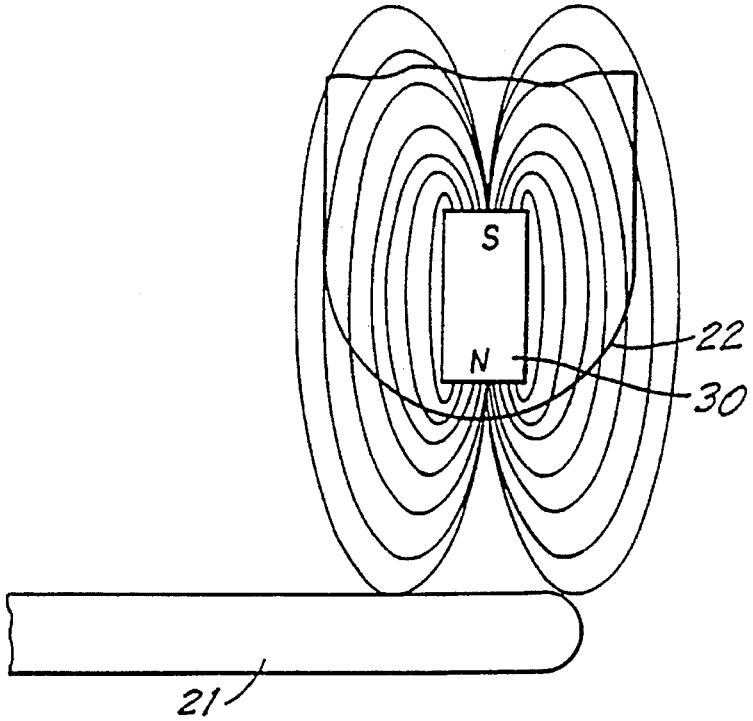
FIGS. 13A and 13B illustrate the use of permanent magnets in the interior cavities of the stationary contacts so as to distinguish or minimize the occurrence of arcing between them and the moving contact disk.

Referring now to FIG. 13A, the stationary contacts 22 and moving contact disk 21 are illustrated in order to describe another feature of the present invention.

As is known in the art of relay design, the introduction of permanent magnets placed somewhat adjacent to the relay contacts will disrupt the environment surrounding the contacts which serves to extinguish arcing, and therefore, reduce its deteriorative effects. These magnets in the present invention are preferably of the small, rare earth type which will produce a large unit volume field strength. In the present invention, magnets are placed inside the cylindrical stationary contacts 22, so that the strong flux lines for arc disruption are directly adjacent to where arcing can occur. Also, by being placed fully inside the stationary contacts 22, the permanent magnets 30 are fully protected from arcing damage.

Figure 13B:
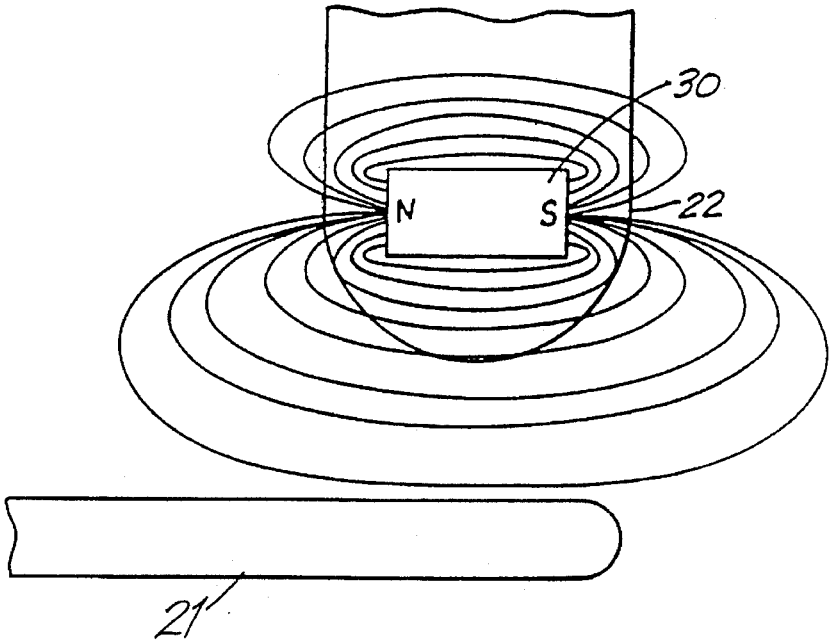

In FIG. 13A illustrates the placement of a permanent magnet 30 inside a stationary contact 22. The permanent magnet 30 is oriented in the vertical direction so that one of its poles is adjacent to the terminal flat A of the stationary contact 22. With the permanent magnet 30 in place, a magnetic field is generated around the magnet and further extends into the area between the contacts 21 and 22. While it is optimal to have the flux lines formed be as parallel as possible to the moving contact disk 21, and therefore perpendicular to the potential arc, such a design would require the horizontal placement of the permanent magnet 30 in the stationary contact 22 as shown in FIG. 13B. This placement, however, may not be physically permissible if the magnet site inside the stationary contact 22 does not permit the magnet 30 to be placed horizontally therein as is illustrated in FIG. 13B inside the stationary contact 22. With the magnet 30 in place as shown in FIG. 13A, arcing may still be extinguished to a certain degree even though all of the flux lines may not be parallel to the moving contact disk 21 and perpendicular to the potential arc. It is most important to note at this juncture that placement of the magnet 30 as shown in FIG. 13A, depending on the physical dimensions of the relay it is employed in and the characteristics of the permanent magnet 30 employed may lead to enhanced arcing if sufficient magnetic flux is not obtained parallel to the moving contact disk 21 perpendicular to the potential arc. As such the design of FIG. 13A may be less preferred but has been made a part of this specification as it may have application in certain cases.

FIG. 13B as described above, illustrates the optimal utilization of permanent magnets 30 within the stationary contacts 22. In FIG. 13B, the magnet 30 is oriented in the horizontal direction as shown so that both of its poles are placed adjacent to the nearest side wall of the stationary contact 22. In this configuration, more lines of flux are parallel to the moving contact disk 21, and therefore, perpendicular to the potential arc. Potential arcing in the arrangement of FIG. 13B will therefore be more effectively extinguished. If physical size constraints permit, the configuration of FIG. 13B is preferred.

FIGS. 14–18 show an alternative and presently preferred embodiment of a sealed relay 51 of this invention. In common with relay 1 described above, relay 51 is a hermetically sealed device which may be evacuated to operate as a vacuum relay or switch, or evacuated and backfilled with a conventional nonconductive gas such as hydrogen (preferably mixed with nitrogen) or sulphur hexafluoride. Relay 51 is suitable for switching either a-c or d-c current, but is particularly useful in high-voltage d-c applications as already described, and which present more challenging requirements for arc suppression and protection of contact surfaces. The coil, core and armature assemblies used in relay 1 are equally useful in relay 51, and a description of these components accordingly need not be repeated.

The following features distinguish relay 51 from relay 1:

a. The internal encapsulated portions of the fixed contacts are shaped to move the circuit-closure surfaces closer together, and a reduced-size ceramic housing has opposed flat side portions.

b. The arc-suppression magnets are positioned against the outer flat sides of the ceramic housing immediately adjacent the fixed contacts to provide a strong magnetic field at the zones of contact closure without any increase in housing size.

c. The contacts are offset in a manner in which provides effective magnetic arc suppression without regard to the direction of d-c current flow through the closed switch.

d. Insulating baffles are provided on and between the inner portions of the fixed terminals to act as dielectric shields which minimize plating out of metal particles (arising from contact-breaking arcing) between the terminals which could short circuit the switch.

Figure 14:
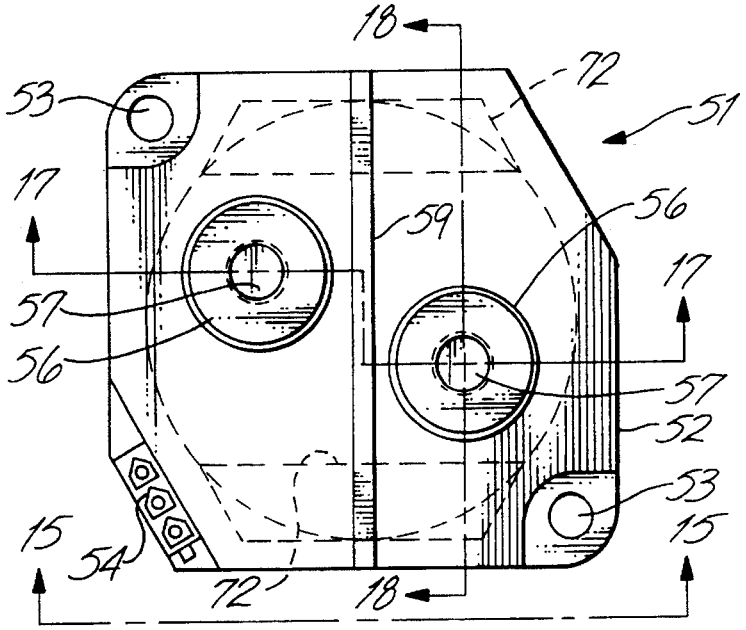
FIG. 14 is a top view of an alternative embodiment of a sealed relay according to the invention.
Figure 15:
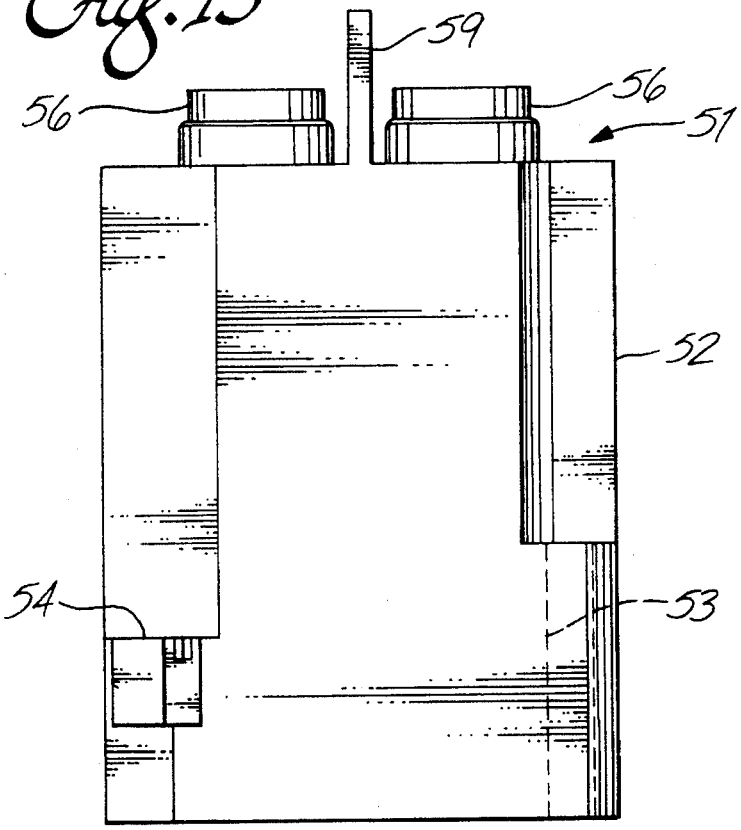
FIG. 15 is a side elevation of the relay shown in FIG. 14.

FIGS. 14–15 are top and side views respectively of an outer plastic housing 52 of relay 51. Mounting-bolt holes 53 are provided at diagonally opposite corners of the housing, and a connector 54 is mounted at a third corner for coupling to a power source for energizing the relay coil (corresponding to coil 26 of relay 1). The outer ends of a pair of stationary or fixed contacts 56 with threaded sockets 57 extend through the top of housing 52. The longitudinal axes of contacts 56 are offset by an angle A (typically about 24 degrees) with respect to a central plane 58 through the top view of FIG. 16. Preferably, a dielectric safety divider wall 59 extends upwardly from the housing upper surface between the contacts to isolate from each other external high-voltage cable terminals or lugs (not shown) bolted to the contacts.

Figure 16:
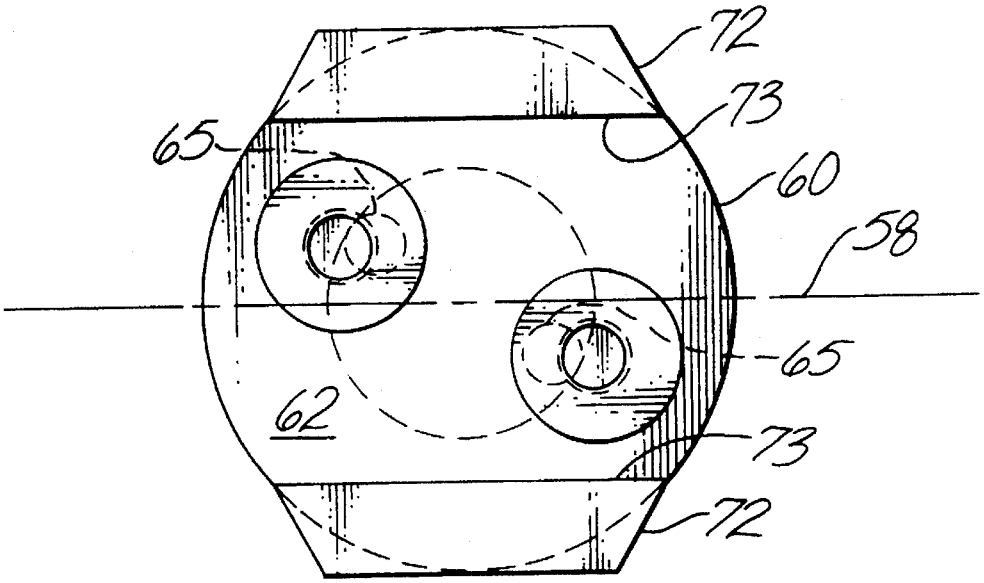
FIG. 16 is a top view of an inner insulated housing of the relay of FIGS. 14 and 15.
Figure 17:
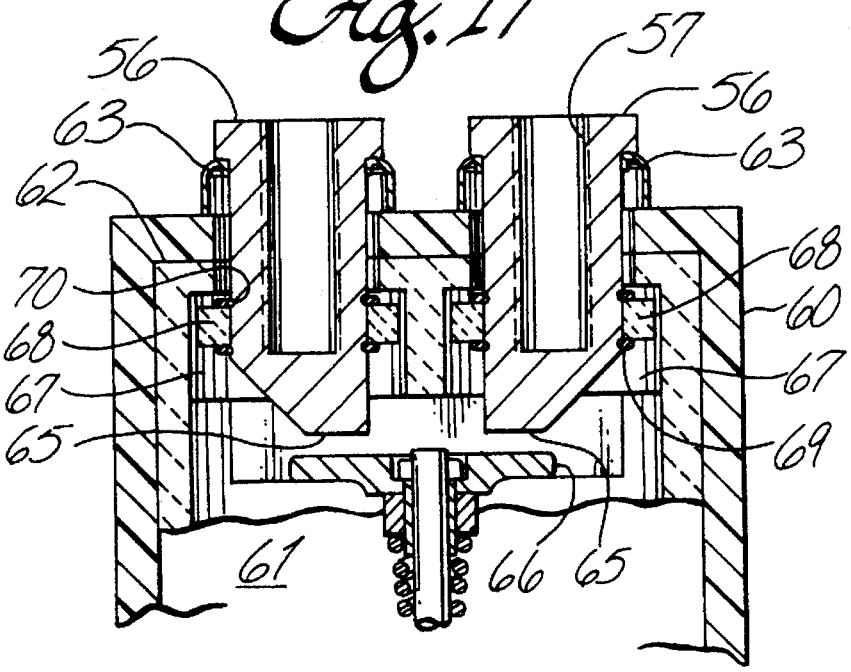
FIG. 17 is a stepped sectional elevation on line 17—17 of FIG. 14.
Figure 18:
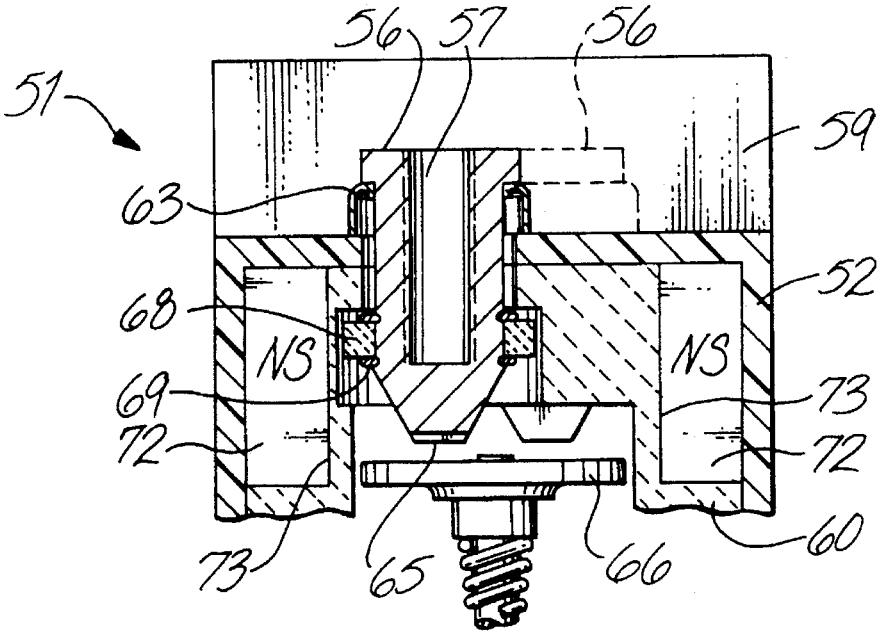
FIG. 18 is a sectional elevation on line 18—18 of FIG. 14.

FIGS. 16–18 show an insulating and preferably ceramic inner housing 60 which is hermetically sealed to the lower coil-enclosing body of the relay to enclose a space 61 which may be evacuated to a high vacuum, or preferably pumped down and backfilled with a dielectric gas such as a hydrogen-nitrogen mixture to a pressure of one or more atmospheres absolute. Fixed contacts 56 extend through a top wall 62 of housing 60, and are sealed and secured to the top wall by brazed Kovar rings 63.

The main body of each fixed contact 56 is cylindrical, but the inner end of each contact is inwardly tapered and chamfered to define a circular flat contact tip (FIG. 16) which mates with a disk-shaped movable contact 66 corresponding to contact disk 21 of relay 1. Contact tips 65 are thus closer together as compared to the fixed-contact surfaces of relay 1, enabling use of a smaller-diameter movable contact.

Top wall 62 of the ceramic housing defines a pair of cylindrical recesses 67 through which the inner portions of fixed contacts 56 extend. A dielectric ceramic ring 68 is mounted on each of the fixed contacts in the annular space defined by recess 67 around the cylindrical portion of the contact body. Rings 68 are secured in place by a pair of metal snap rings 69 seated in a pair of spaced-apart annular grooves 70 formed in each contact body. The fixed contacts are made of oxygen-free high-conductivity copper which is preferably a dispersion-strengthened copper-alumina material available from SCM Metals under the trademark GLIDCOP.

As shown in FIGS. 14–16, a pair of bar magnets 72 are adhesively secured to mating flat surfaces 73 on opposite sides of ceramic inner housing 60, each magnet being positioned immediately adjacent one of the fixed contacts within the housing. The inner surfaces of the magnets and mating flat surfaces 73 are parallel to centerline 60, and are spaced equidistantly from opposite sides of the centerline.

Figure 20:
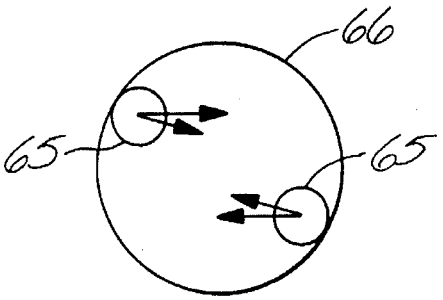
FIG. 20 is a view similar to FIG. 19, and showing arc blowout for an opposite-polarity connection.
Figure 19:
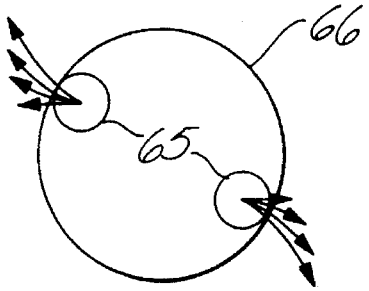
FIG. 19 is a schematic illustration of arc blowout when the relay connected in a first polarity.

The arc-suppressing properties of the fields of these magnets has already been described. In one polarity connection of the relay when used as a d-c switch or contactor, the arc-blowout effect of the magnetic fields acts in an outward direction (FIG. 19) toward the inner sidewall of ceramic housing 60. For an opposite-polarity connection, the blowout effect is inwardly directed (FIG. 20), but the offset positioning of the fixed contacts prevents the effect from being directed from one contact toward the second contact which could interfere with effective arc suppression.

While the present invention has been described in its preferred embodiment, it is to be understood that the above descriptions are merely illustrative of the present invention and not a limitation thereof. Therefore, the present invention covers all modifications, alterations, or variations which fall within the scope and spirit of the principles taught by the present invention.

We claim:

1. A sealed relay, comprising:

a housing defining a sealed chamber, at least a portion of the housing being made of a dielectric material;

a pair of spaced-apart fixed contacts secured to and extending through the dielectric housing portion into the sealed chamber, the fixed contacts having inner portions extending toward each other and terminating in flat contact surfaces;

an electromagnetically activated armature assembly mounted on the housing within the sealed chamber, the assembly having an armature shaft with a terminal end portion, and a movable contact connected to the armature shaft adjacent the terminal end portion, the armature assembly being movable between a first position in which the movable contact is spaced from the fixed contacts, and a second position in which the movable contact is positioned against the fixed contacts to complete a conductive path therebetween; the terminal end portion being arranged for overtravel beyond the movable contact in the second position to provide an impact contact-breaking force when travel from the second position to the first position is initiated; and a pair of parallel and spaced-apart permanent magnets secured to opposite external side surfaces of the housing adjacent the flat contact surfaces of the respective fixed contacts, the magnets being on opposite sides of and substantially equidistantly spaced from a central plane extending therebetween, the fixed contacts being offset on opposite sides of the central plane.

2. The relay defined in claim i in which the magnet-mounting external side surfaces of the housing are flat.

3. The relay defined in claim 2 in which the sealed chamber is evacuated to a high vacuum.

4. The relay defined in claim 2 in which the sealed chamber is filled with an insulating gas.

5. The relay defined in claim 4 wherein the insulating gas is a mixture of hydrogen and nitrogen.

6. The relay of claim 1 in which each fixed contact has secured thereto an insulated ring spaced from the flat contact surface.

7. The relay of claim 1 in which the movable contact is a disk having a diameter substantially equal to a circle which encloses the flat contact surfaces of the fixed contacts.

8. The relay of claim 7 wherein the flat contact surfaces of the fixed contacts are circular.

9. The relay of claim 8 in which the magnet-mounting external side surfaces of the housing are flat, and the sealed chamber is filled with an insulating gas.

10. The relay of claim 9 in which all movable components of the armature assembly are enclosed in the sealed chamber.

* * * * *